United States Patent [19]

Smith et al.

[11] Patent Number: 4,545,917

[45] Date of Patent: Oct. 8, 1985

[54] AUTOMATIC DISHWASHER PRODUCT IN SOLID FORM

[75] Inventors: James A. Smith, Old Tappan; George W. Kellett, Jr., Cranford, both of N.J.

[73] Assignee: Creative Products Resource Associates Ltd., Clifton, N.J.

[21] Appl. No.: 578,737

[22] Filed: Feb. 9, 1984

[51] Int. Cl.[4] ..... A47L 15/44; C11D 1/722; C11D 3/37; C11D 17/04

[52] U.S. Cl. ..... 252/90; 252/174; 252/174.11; 252/174.21; 252/174.22; 252/174.23; 252/DIG. 1, DIG. 16; 137/268

[58] Field of Search ..... 252/89.1, 90, 174, 174.21, 252/174.22, 174.23, 548, DIG. 1, 174.11, DIG. 16

[56] References Cited

U.S. PATENT DOCUMENTS

| | | | |
|---|---|---|---|
| 2,555,047 | 5/1951 | Logue | 239/58 |
| 2,657,090 | 10/1953 | Meek | 239/55 |
| 2,836,462 | 5/1958 | Wenner | 239/57 |
| 3,272,899 | 9/1966 | Diamond | 264/126 |
| 3,286,872 | 11/1966 | Burdick | 220/41 |
| 3,312,626 | 4/1967 | Hooker | 252/548 |
| 3,340,309 | 9/1967 | Weipert | 252/174.21 |
| 3,629,127 | 12/1971 | Palmer | 252/55 |
| 4,226,736 | 10/1980 | Bush | 252/135 |
| 4,260,528 | 4/1981 | Fox | 252/525 |
| 4,396,522 | 8/1983 | Callicot | 252/163 |

FOREIGN PATENT DOCUMENTS

| | | | |
|---|---|---|---|
| 1112534 | 11/1981 | Canada | 252/90 |
| 0003769 | 5/1979 | European Pat. Off. | 252/90 |

OTHER PUBLICATIONS

Weipert, E. A., et al.: "Biodegradable Rinse Additives", *Soap & Chemical Specialties*, Feb. 1968, pp. 48, 50, 52 and 107.

*Primary Examiner*—Dennis L. Albrecht
*Attorney, Agent, or Firm*—Kenyon & Kenyon

[57] ABSTRACT

An automatic dishwasher product comprising, in combination, a dispenser with openings therein and a water soluble solid composition positioned therein which comprises a high molecular weight polyethylene glycol, a non-ionic fatty acid alkanolamide, an oxyethylated alcohol, a non-ionic amine polyglycol condensate and, optionally, a fragrance, the measured release of said composition serving to increase detergent action and minimize spotting.

13 Claims, 1 Drawing Figure

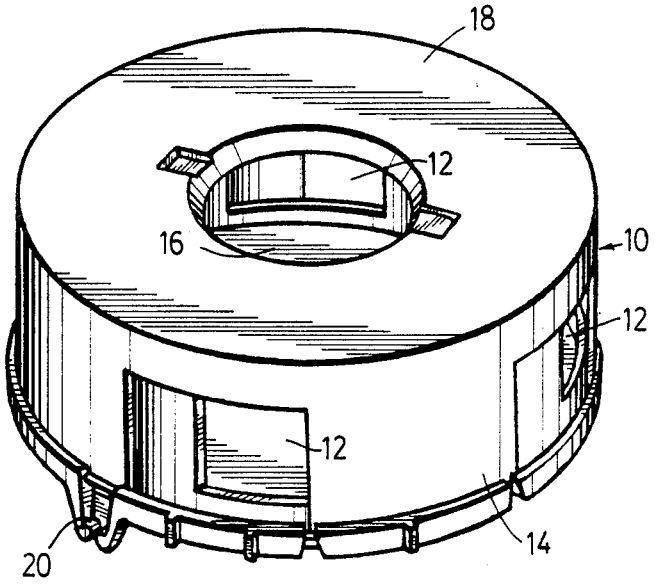
18
12
16
10
12
12
20
14

AUTOMATIC DISHWASHER PRODUCT IN SOLID FORM

Various materials have been suspended in automatic dishwashers for the primary purpose of eliminating spotting on silverware, dishes and glassware. Liquids which generally comprise blends of surfactant, glycol and water are limited in activity and in duration of release particularly since they only function during the rinse cycle. Solid materials, on the other hand, must exhibit adequate water solubility to release active ingredient, while simultaneously controlling solubility so as to be available over a reasonable period of time. They must be stable at the heat conditions encountered during the drying cycle in automatic dishwashers so as to maintain physical and chemical integrity. Finally, if a fragrance is present, the fragrance should provide a pleasant odor without plating out on the dishes and leaving residual odor and/or taste. Existing materials have not met all of these criteria.

It is, accordingly, the primary object of this invention to provide a dispenser-solid formulation product for use in automatic dishwashers which exhibits both effective release and performance characteristics.

It is another object to provide a solid formulation component which complies with the above recited physical and performance requirements.

It is a further object to provide such a solid formulation which exhibits additional performance characteristics such as cleansing enhancement.

Various other objects and advantages of this invention will become evident from the following description thereof.

We have surprisingly discovered that by combining various polyethylene glycols and non-ionic surfactants, a solid dispensing system is obtained which exhibits excellent performance characteristics when utilized in automatic dishwashers. Thus, the product is a controlled dispensing system that works both in the wash and rinse cycles to help keep dishes, silverware and glassware clean and spotfree. The product has low water absorptivity yet exhibits efficient and controlled solubility in both detergent water and rinse water. The product has similar solubility properties regardless of whether it is used in soft or hard water conditions in the presence of detergent. In addition, the product enhances detergent action in the wash cycle, reducing the amount of dishwasher detergent utilized for each load. It functions in the rinse cycle by complexing or reducing the effects of dissolved hard water salts, thereby eliminating most spots and streaks. Continued use of the product over a period of time serves to dissolve film deposits which have built up. The product is stable under the heat cycle conditions typically encountered in automatic dishwashers. Finally, the formulation allows for the use of fragrances which provide a pleasant aroma in the dishwasher and kitchen without leaving a residual odor and/or taste on the dishes. Accordingly, an effective stable dishwasher product is produced.

In terms of actual use in a dishwasher, it has been determined that the product is most efficiently dispensed when housed in a dispenser with multiple openings therein, said openings being of predetermined area. In this manner, when the water flows over the exposed surface areas of solid formulation, adequate amounts are solubilized and dispensed to be effective within the work load during a single full cycle. Correspondingly, this controlled water exposure and distribution further assist the solid material to maintain its integrity and to be available for use for the desired and commercially acceptable duration.

Solid, high molecular weight polyethylene glycol systems are applicable for use in the instant compositions. Such systems may be composed of individual solid polyethylene glycols, blends of solid polyethylene glycols or blends of solid and liquid polyethylene glycols. In all instances, it is necessary that the glycol system exhibit a minimum molecular weight of about 4,000 and a measurable water solubility in order to function in the instant formulations. The actual degree of water solubility will depend on the desired release rate. The glycols serve as an absorptive base for the total composition. Such glycols are commercially available under the CARBOWAX trademark from Union Carbide Corp., with CARBOWAX 6000 being preferred.

The non-ionic surfactant portion of the instant systems is composed of three different materials. The first such component is a solid, fatty acid alkanolamide having generally 10–24 carbon atoms in the fatty acid moiety such, for example, as stearic alkanolamide. The non-ionic character of this solid component strongly influences in a positive manner the cleaning capabilities of the detergent. The primary function of this ingredient is to control the solubility of the total composition by limiting the water absorptive capability thereof. It also serves to increase the shine of the washed and dried dishware and glassware. A coconut monoethanolamide is preferred.

The second component is a modified oxyethylated straight chain alcohol with generally 8–18 carbon atoms in the alcohol chain. The ingredient provides detergent, dispersant, wetting and emulsification properties and is particularly valuable in such dishwasher compositions because of its low foaming characteristics. Solubility of the system is also modified by this ingredient, the solubility being inversely proportional to the concentration of this ingredient.

The third component is a non-ionic amine polyglycol condensate. A typical amine for use herein may be ethylene diamine. This ingredient also exhibits detergent, wetting and low foaming characteristics. Its amine function enables it to coordinate well in the final composition with the alkanolamide.

A fragrance may be optionally present in these compositions. Although most available fragrance compositions may be utilized, it is important that the fragrance have a pleasant olfactory response without leaving a residual odor or taste on the items being cleaned in the dishwasher. Depending on the nature of the fragrance, it is also possible that the selected fragrance may contribute to the cleaning operation.

In terms of relative weight concentrations, the polyethylene glycol is present in amounts of 30–45%, and preferably 37–40%; the alkanolamide in amounts of 15–25%, and preferably 17–20%; and the oxyethylated alcohol and the amine polyglycol condensate in a combined amount of 30–55%, and preferably 32–38%, with the alcohol and condensate being present in 3:1–1:3 weight ratios. Where a fragrance is present, it is used in amounts of 3–15%, and preferably 7–10%.

The solid dishwasher product is prepared by blending the polyethylene glycol system and the non-ionic ingredients, heating the blend to 90°–100° C. so as to prepare a clear, totally soluble melt, then blending in the fragrance, if present, reheating to 90°–100° C. and pouring the hot melt into a mold for solidification at room temperature. Alternately, it is possible to add the amine polyglycol condensate individually or as part of a fragrance blend to the heated melt.

The solid product may be contained in any suitable dispenser that has openings to allow adequate flow of water over the solid and that can be properly suspended in the dishwasher.

BRIEF DESCRIPTION OF THE DRAWING

A typical dispenser is depicted (in a perspective view) in the drawing which forms part of the instant specification.

As noted, dispenser 10 contains openings 12 in the side wall 14 thereof and opening 16 in the top surface 18 thereof. Means are provided for adjusting the size of the side openings 12 according to the temperature of the water, a larger opening being utilized for cooler water. Clips 20 are utilized to attach dispenser 10 to the dishwasher basket preferably in a vertical position.

Based on the composition of the solid formulation and the size of the dispenser openings, it is preferred that from 0.5–2.0 grams of solids are dissolved and dispensed per wash load utilizing water (e.g. detergent-containing water or rinse water) at a temperature ranging from about 40°–80° C. A top opening of 20 $cm^2$ in area and four side openings ranging from 0.6–2.5 $cm^2$ in area each will generally provide the desired distribution of product, with a preferred value being about 1.0 gram consumed per work load. Utilizing these values, the product should preferably last 30–40 wash cycles based on its controlled solubility characteristics and its resistance to degradation at elevated drying temperatures. The latter temperatures will generally range from 70°–95° C. in conventional dishwashers. The product exhibits excellent performance characteristics in terms of eliminating spots and streaks, enhancing detergent activity and dissolving mineral build-up.

The following examples further illustrate the embodiments of this invention. In these examples, all parts given are by weight unless otherwise specified.

EXAMPLE I

This example illustrates the preparation of a typical solid dishwasher composition of the instant invention.

The following ingredients were utilized:

| | Parts |
|---|---|
| polyethylene glycol (MW = 6000) | 40.50 |
| coconut monoethanolamide | 19.50 |
| oxyethylated alcohol (1) | 19.69 |
| amine polyglycol condensate (2) | 15.31 |
| fragrance | 5.00 |

(1) PLURAFAC RA-30 (BASF Wyandotte)
(2) TRITON CF-32 (Rohm & Haas)

All of the ingredients except for the fragrance were charged to a mixing vessel and then heated to 95° C. with constant stirring. The fragrance was then added, the temperature was raised back to 95° C. and stirring continued until a clear, uniform melt was obtained. The liquid material was poured into aluminum dishes and allowed to cool to room temperature for approximatey two hours. After solidification, a hard product with a good crystalline structure was obtained. The product had exhibited minimun shrinkage during cooling.

The resulting samples were then subjected to various test procedures.

Flow Temperature

One sample of product is placed in a test tube which is then inverted in a water bath. The water temperature is raised 0.5° C. per minute. The temperature at which the product starts to flow is noted as its flow temperature. Pursuant to this procedure, a flow temperature of 77° C. was noted for the formulation of this example, clearly indicating the potential for the product to withstand the temperatures of about 70°–95° C. generally encountered during the drying cycle.

Dip Test

This test determines the solubility characteristics of the product. 1000 grams of a stock solution of 25 grams of solid dishwasher detergent (CASCADE) in 7.6 liters of water is placed in a deep vessel, heated to 65° C. and maintained at that temperature with constant stirring. A 15 gram disk of the above prepared formulation is weighed, placed into a strainer and immersed in the detergent solution. The disk is immersed for five minutes, allowed to drain for twenty minutes, weighed, allowed to dry for a 24 hour period and reweighed. The test is repeated for a pre-determined number of dips. The appearance of the disk is also observed during the sequential dips. The following results were obtained:

| | |
|---|---|
| Initial weight (grams) | 16.65 |
| Dip 1 | 16.54 |
| Dip 2 | 16.00 |
| Dip 3 | 15.58 |
| Dip 4 | 15.53 |
| Dip 5 | 15.00 |

A pattern of controlled solubility was thus noted. Likewise, the disk maintained its integrity during the dipping operation.

Dishwasher Test

A dispenser as depicted in the drawing having a top opening of 20 $cm^2$ and four side openings of 1.2 $cm^2$ each was loaded with a weighed sample of product and suspended in a conventional dishwasher loaded with a 25 gram sample of solid detergent. Full wash (62° C.), rinse (62° C.) and dry (77° C.) cycles were run and the disk weighed after each complete sequence of cycles. The following results were obtained with the product of this example.

| | Grams |
|---|---|
| Initial | 47.66 |
| Cycle 1 | 46.68 |
| Cycle 2 | 46.00 |
| Cycle 3 | 45.22 |
| Cycle 4 | 45.02 |
| Cycle 5 | 44.34 |
| Cycle 6 | 43.85 |
| Cycle 7 | 43.12 |
| Cycle 8 | 41.20 |
| Cycle 9 | 41.68 |
| Cycle 10 | 40.78 |
| Cycle 11 | 38.83 |
| Cycle 12 | 38.10 |
| Cycle 13 | 35.29 |
| | $\Delta W$ = 12.37 grams |

An average loss of 0.95 grams/cycle was exhibited. It is anticipated that the product would be effective over 37 loads of dishes. A product with excellent performance characteristics is thus noted.

EXAMPLE II

The following formulations were prepared in a manner similar to that specified in Example I. Blending temperatures ranged from 90°-100° C. in all instances.

| | 2 | 3 | 4 | 5 | 6 | 7 | 8 | 9 | 10 | 11 | 12 |
|---|---|---|---|---|---|---|---|---|---|---|---|
| polyethylene glycol (MW = 6000) | 37.50 | 28.13 | 18.75 | 9.37 | — | 36.00 | 37.50 | 37.50 | 37.50 | 37.50 | 38.33 |
| polyethylene glycol (MW = 14,000) | — | 9.37 | 18.75 | 28.13 | 37.50 | — | — | — | — | — | — |
| coconut monoethanolamide | 17.50 | 17.50 | 17.50 | 17.50 | 17.50 | 17.50 | 12.25 | — | 17.50 | 17.50 | 17.89 |
| oxyethylated alcohol (1) | 8.75 | 8.75 | 8.75 | 8.75 | 8.75 | 8.75 | 8.75 | 8.75 | 17.50 | 26.25 | 8.94 |
| amine polyglycol condensate (2) | 26.25 | 26.25 | 26.25 | 26.25 | 26.25 | 26.25 | 26.25 | 26.25 | 17.50 | 8.75 | 26.84 |
| fragrance | 10– | 10– | 10– | 10– | 10– | 10– | 10– | 10– | 10– | 10– | 8– |
| glycerin | — | — | — | — | — | 1.40 | — | — | — | — | — |
| alkanolamide (3) | — | — | — | — | — | — | 5.25 | 17.50 | — | — | — |
| flow temp. (°C.) | 76.6 | 77.7 | 77.7 | 78.3 | 85.0 | — | — | — | — | — | — |
| dip test (g./dip) | 0.26 | 0.33 | 0.23 | 0.28 | 0.13 | — | — | — | 0.46 | 0.57 | 0.43 |
| # loads | — | — | — | — | — | — | — | — | — | — | 71 |

| | 13 | 14 | 15 | 16 | 17 | 18 | 19 | 20 | 21 | 22 |
|---|---|---|---|---|---|---|---|---|---|---|
| polyethylene glycol (MW = 6000) | 37.50 | 37.50 | 37.50 | 38.50 | 40.50 | 41.7 | 37.50 | 37.50 | 38.50 | 38.50 |
| polyethylene glycol (MW = 14,000) | — | — | — | — | — | — | — | — | — | — |
| coconut monoethanolamide | 17.50 | 17.50 | 17.50 | 19.50 | 19.50 | 19.4 | 19.50 | 19.50 | 19.50 | 19.50 |
| oxyethylated alcohol (1) | 10.94 | 13.13 | 15.31 | 17.50 | 17.50 | 9.7 | 15.31 | 17.50 | 19.69 | 21.87 |
| amine polyglycol condensate (2) | 24.06 | 21.87 | 19.69 | 17.50 | 17.50 | 29.2 | 19.69 | 17.50 | 15.31 | 13.13 |
| fragrance | 10– | — | — | 7– | 5– | — | 8– | 8– | 7– | 7– |
| glycerin | — | — | — | — | — | — | — | — | — | — |
| alkanolamide (3) | — | — | — | — | — | — | — | — | — | — |
| flow temp. (°C.) | — | — | — | — | — | — | 84 | 84 | — | — |
| dip test (g./dip) | 0.44 | 0.56 | 0.65 | 0.41 | 0.35 | — | 0.28 | 0.37 | 0.36 | 0.45 |
| # loads | — | — | — | 54 | — | — | 57 | 55 | 60 | 37 |

(3) MONAMIDE S (MONA INDUSTRIES)

The excellent performance characteristics of the formulations of this invention were thus confirmed.

Summarizing, it is seen that this invention provides solid dishwasher products which exhibit excellent physical and performance characteristics. Variations may be made in proportion, procedures and materials without departing from the scope of this invention as defined by the following claims.

What is claimed is:

1. A solid composition of matter suitable for use as a cleansing or rinsing agent in an automatic dishwasher comprising (a) from about 30–45%, by weight, of a polyethylene glycol or a blend of polyethylene glycols, said glycol or said blend thereof having a minimum molecular weight of about 4000;

(b) from about 15–25%, by weight, of a non-ionic solid, fatty acid alkanolamide having 10–24 carbon atoms in the fatty acid moiety;

(c) low foaming a non-ionic modified oxyethylated straight chain alcohol having 8–18 carbon atoms in the alcohol chain; and (d) low-foaming a non-ionic ethylene diamine polyglycol condensate; components (c) and (d) being present in a combined concentration of 30–55%, by weight, with the weight ratio of (c) to (d) ranging from 3:1–1:3.

2. A composition of claim 1 which also contains from 3–15%, by weight, of a fragrance.

3. The composition of claim 2, wherein the respective weight concentrations are 37–40% of (a), 17–20% of (b), 32–38% of (c) and (d), and 7–10% of fragrance.

4. The composition of claim 1, wherein component (a) is a polyethylene glycol having a molecular weight of 6,000.

5. The composition of claim 1, wherein component (b) is coconut monoethanolamide.

6. The composition of claim 1 which comprises:
40.50%, by weight, polyethylene glycol (MW=6,000)
19.50%, by weight, coconut monoethanolamide
19.69%, by weight, component (c)
15.31%, by weight, component (d)
5.00%, by weight, fragrance.

7. An automatic dishwasher product comprising, in combination, a dispenser having top, side and bottom surfaces with a plurality of openings therein and a solid, water soluble composition corresponding to claim 1 positioned therein, the area of said openings and the water solubility of said composition being selected so as to solubilize and release 0.5–2.0 grams of said composition when water at a temperature of from 40°–80° C. flows over the surface areas of said composition exposed through said openings.

8. The product of claim 7, wherein said composition also contains from 3–15%, by weight, of fragrance.

9. The product of claim 8, wherein the respective weight concentrations are 37–40% of (a), 17–20% of (b), 32–38% of (c) and (d), and 7–10% of fragrance.

10. The product of claim 7, wherein component (a) is a polyethylene glycol having a molecular weight of 6,000.

11. The product of claim 7, wherein component (b) is coconut monoethanolamide.

12. The product of claim 7, where said composition comprises:

40.50%, by weight, polyethylene glycol (MW=6,000)
19.50%, by weight, coconut monoethanolamide
19.69%, by weight, component (c)
15.31%, by weight, component (d)
5.00%, by weight, fragrance.

13. The product of claim 7, wherein said dispenser has a single opening in the top surface thereof having an area of 20 $cm^2$ and four openings in the side surface thereof having an area of from 0.6–2.5 $cm^2$ per opening.

* * * * *